United States Patent [19]

Bulka et al.

[11] Patent Number: 4,711,440

[45] Date of Patent: Dec. 8, 1987

[54] SIGNATURE MACHINE WITH COUNTERPULSE WEIGHT SHUTTLE BAR DRIVE

[75] Inventors: Raymond I. Bulka, Oak Lawn; David J. Nowaczyk, Chicago, both of Ill.

[73] Assignee: McCain Manufacturing Corporation, Chicago, Ill.

[21] Appl. No.: 931,054

[22] Filed: Nov. 17, 1986

[51] Int. Cl.[4] ..... B42B 1/02

[52] U.S. Cl. ..... 270/53; 227/100

[58] Field of Search ..... 270/53, 37–38; 227/99–102

[56] References Cited

U.S. PATENT DOCUMENTS

| | | | |
|---|---|---|---|
| 2,895,730 | 7/1959 | Biez et al. | 270/37 |
| 3,032,336 | 5/1962 | Heigl et al. | 270/53 |
| 3,057,620 | 10/1962 | McCain | 270/53 |
| 3,281,045 | 10/1966 | Schmidt | 227/100 X |
| 3,554,531 | 1/1971 | Heigl | 270/53 |
| 3,613,217 | 10/1971 | Perkins | 227/100 X |
| 3,664,564 | 5/1972 | Stanton et al. | 227/100 |
| 3,966,185 | 6/1976 | McCain et al. | 270/37 |
| 4,236,706 | 12/1980 | Schlough | 270/53 |
| 4,519,598 | 5/1985 | McCain et al. | 270/53 |
| 4,614,290 | 9/1986 | Boss | 227/100 X |

*Primary Examiner*—E. H. Eickholt

*Attorney, Agent, or Firm*—Kinzer, Plyer, Dorn, McEachran & Jambor

[57] ABSTRACT

Harmonic vibrations in a signature machine due to the inertial influence of a reciprocating mass comprising grippers and associated parts are reduced by using a planetary gear drive and a weight secured thereto; momentum of the gripper mass is countered by another rotating weight. The planetary gear drive may be either epicyclic or hypocyclic, depending principally upon the length of the reciprocal stroke.

16 Claims, 10 Drawing Figures

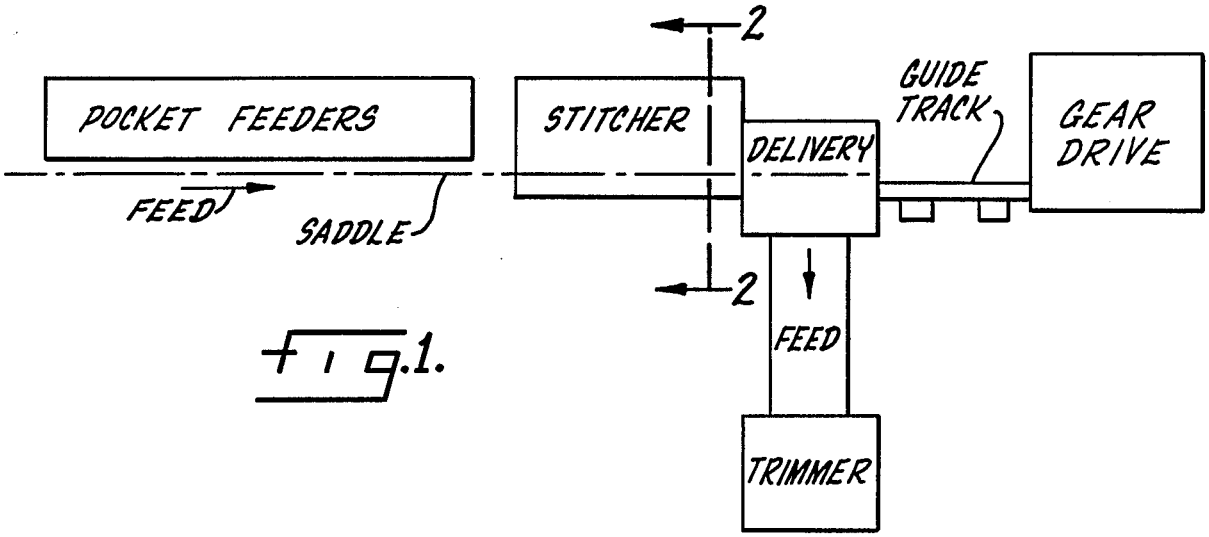
Fig.1.
Fig.2.
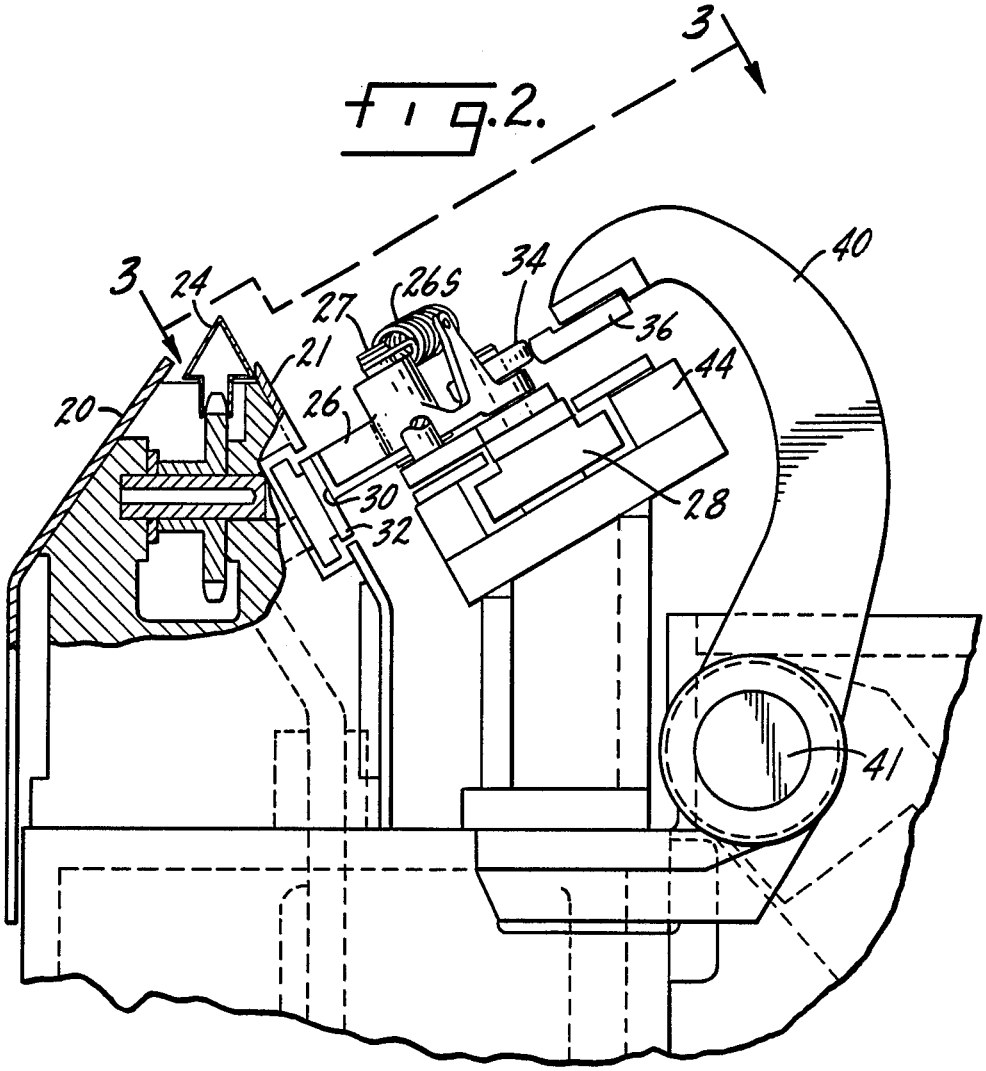

Fig. 8.
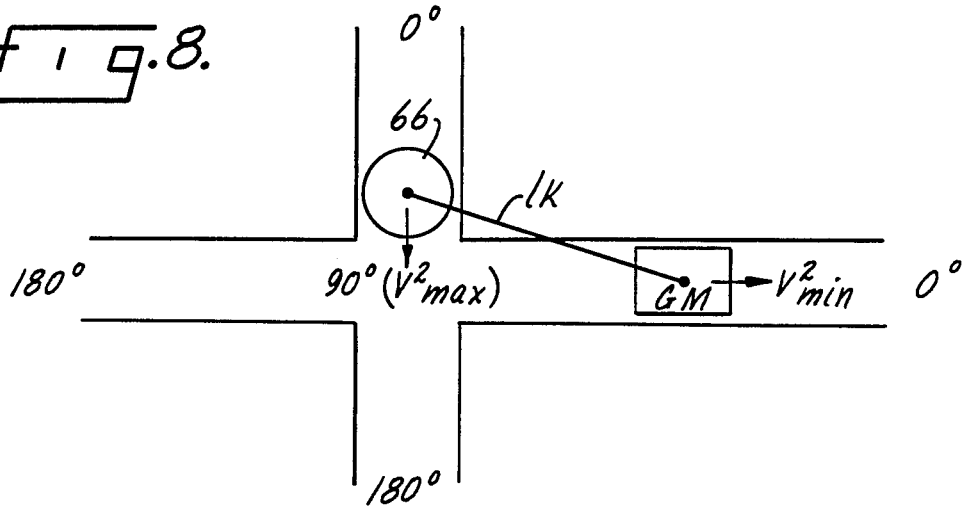
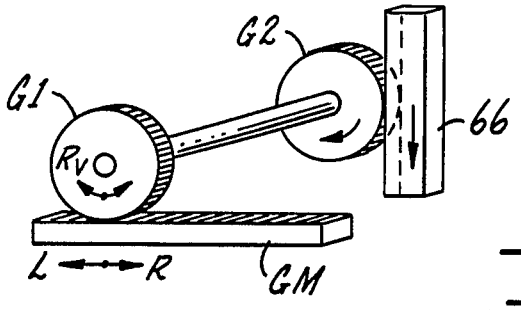
Fig. 9.
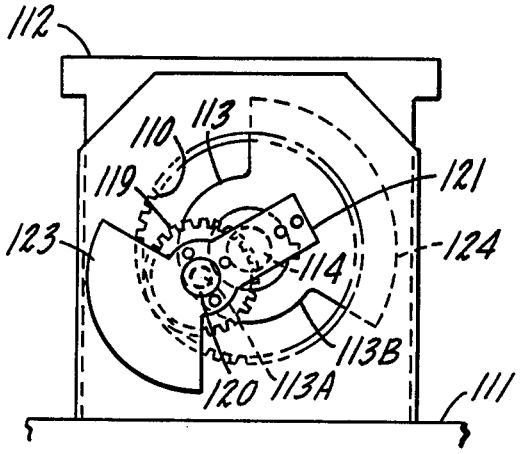
Fig. 10.

SIGNATURE MACHINE WITH COUNTERPULSE WEIGHT SHUTTLE BAR DRIVE

This invention relates to a cyclically operable signature machine having a conveyor in which signatures are collected one atop another as they are fed from hoppers to the conveyor which moves the collected signatures, constituting an unbound book, to a binder station where the signatures are joined at their backs to afford a bound book.

BACKGROUND OF THE INVENTION

The conveyor in a signature machine may be of considerable length and there may be as many as thirty or forty hoppers from which the signatures are fed. The machine includes subcombinations such as inserters, trimmers, stitcher heads, mailers and diverters.

The conveyor on which the signatures are collected delivers the unbound books to stitcher heads at a stitching station. In a conventional arrangement, there are individual grippers at the stitching station which move the books stepwise through the stitching station in the direction of a diverter, trimmer, mailer or some other unit, any one of which will have its own drive connection, especially the trimmers. The grippers are carried by a long, heavy gripper support which is reciprocated by a gripper bar and because crank motion in the conventional arrangement is involved for reciprocating the gripper mass, harmonic motion is necessarily involved. Harmonic motion means vibration and indeed the two are equated in classic mechanics. In a large machine, this is a problem of considerable magnitude because the masses involved can cause the machine to shake and pulse. The present invention addresses these problems.

Others have addressed the problem and one solution proposed was to retime some of the chain drives. Retiming is theoretically an answer but in the practical sense this would more or less require constant supervision because the user frequently makes changes in timing to accommodate to book size, or when performing 3-knife or 5-knife trimming, or for other reasons. We have determined upon a different answer.

OBJECTIVES AND GENERAL DESCRIPTION OF THE INVENTION

The primary object of the present invention is to address the problem of harmonic vibrations in a signature machine of the kind described and to solve this problem by employing a planetary gear in an unusual way. More specifically, it is an object of the present invention to rely on a crank driven by a planetary gear to reciprocate the gripper mass while at the same time using the planetary gear to oscillate a weight harmonically so that the harmonics of the weight tend to cancel or balance the harmonics (referred to in the art as a "shaft pulsing") established by the vibrating or reciprocating gripper mass.

A further object of the present invention is to introduce an additional weight which counters the momentum of the gripper mass in order to reduce shaking of the machine.

THE DRAWING

FIG. 1 is a diagrammatic view of an arrangement in a signature machine in which the present invention may be employed;

FIG. 2 is a sectional view at the stitcher station, substantially on the line 2—2 of FIG. 1;

FIGS. 8 and 9 are schematic drawings used to explain pulse attenuation;

FIG. 10 is an assembly view showing an alternate hypocyclic drive.

DETAILED DESCRIPTION

The general arrangement of a signature machine in which the present invention may be embodied is illustrated diagrammatically in FIG. 1. The signatures or folded sheets are delivered from individual pockets or hoppers identified in FIG. 1 as a long series of pocket feeders. The folded signatures fed from the hoppers are collected one atop another on an elongated, horizontal saddle which in FIG. 2 is shown as comprising a pair of inclined plates 20 and 21 between which a long, chain-driven, endless conveyor 24 is positioned. The conveyor includes individual pushers (not shown) so spaced from one another as to enable the signatures to be collected and captured therebetween. The signatures thus collected are advanced as an unbound, collected group to the stitcher station (FIG. 1) where the backs of the signatures are stapled or otherwise bound.

The bound books are delivered one-by-one from the stitcher to a delivery station and from here the books are (or may be) fed to a trimmer, to a mailer or to some other station involving chain drives. The machine may include a diverter to remove incomplete books. There may be a stacker to stack books, a collator, and so on.

The conveyor 24 reverses itself at the stitcher station and releases the books to a series of grippers 26 (see FIGS. 2 and 3) pivotally mounted in tandem relation on a massive gripper support 28. This mass is located at one side of the saddle.

Figure 3:
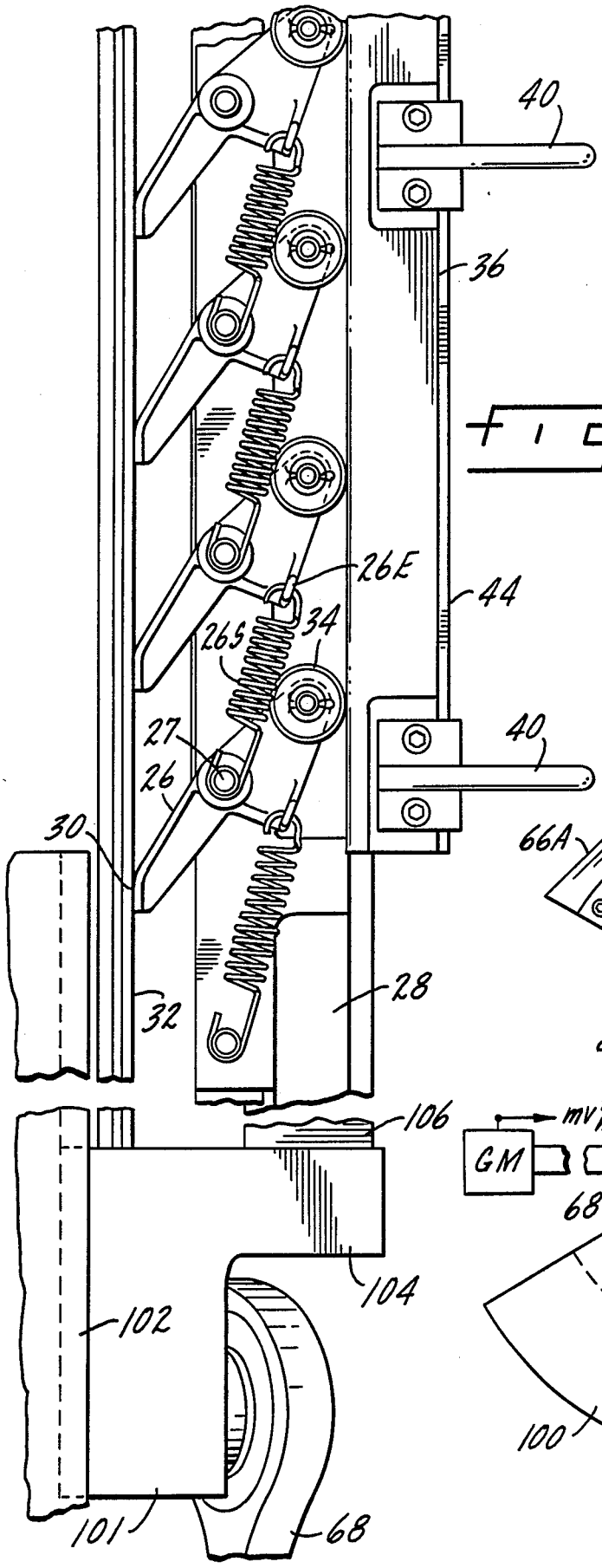
FIG. 3 is a fragmentary top plan view of a portion of the gripper feed at the stitching station, taken at the front of the machine as viewed along line 3—3 of FIG. 2.

Each gripper 26 is pivotally mounted on an upright pin 27 fixed to the gripper support 28, and as best shown in FIG. 3, a spring 26S is tensioned between an ear 26E on one gripper and the pivot pin 27 of the adjacent gripper so that the spring is effective to force the shoe surface 30, FIG. 2, of a gripper toward an opposed reciprocating anvil bar 32, together advancing the book gripped therebetween.

Thus the support 28 has a 180° advancing stroke from start position to the bottom as viewed in FIG. 3, advancing the books through the stitcher station in the direction of the delivery station. The gripper support also has a return nonfeed stroke (180° return back to 360° start position) and during the return stroke the grippers 26 are released or retracted relative to the feeder anvil 32. This releasing action is achieved by pivoting the grippers collectively in the counterclockwise direction as viewed in FIG. 2. To accomplish this, a gripper release bar 36 is actuated to engage simultaneously gripper release rollers 34 carried at the end of each gripper. The gripper release bar is supported by a plurality of arms 40 which at their lower ends are secured to a rock shaft 41. From FIG. 2 it can be seen that by rotating the rock shaft 41 counterclockwise the arms 40 are rocked to force the gripper release bar 36 against the rollers 34 producing the gripper release action identified above, which occurs at the end at the forward 180° stroke of the gripper support 28.

A considerable mass is involved. There may be as many as twenty or more individual grippers 26 spread out along the support 28 over a distance of eight feet or more. The reciprocal members as 28 and 32 constitute additional mass. In the past, an ordinary crank motion has been employed to reciprocate this mass such that harmonic motion is involved. Harmonic motion means unneeded, damaging vibration and the present invention addresses this problem.

In accordance with the present invention, and in order to minimize vibration in the machine as a result of the reciprocating masses described above, a planetary gear drive is used to impart to and fro (reciprocating) motion to the gripper support 28. This planetary gear drive itself involves harmonic (crank) motion, and indeed in a machine of this kind no arrangement has yet been devised, for shuttling the gripper mass, which does not involve harmonic motion. However, by also employing the planetary gear to revolve a weight (the midpoint of which oscillates up and down) it becomes possible under the present invention to oppose or dampen the repeated pulses in the machine due to cyclic reversal of the gripper mass so that to this extent pulses or vibrations in the machine originating with reversal of the gripper mass are minimized, if not altogether canceled, in a practical sense.

An additional weight is employed, as will be explained separately, to oppose the momentum of the gripper mass at the point of its maximum velocity.

Figure 6:
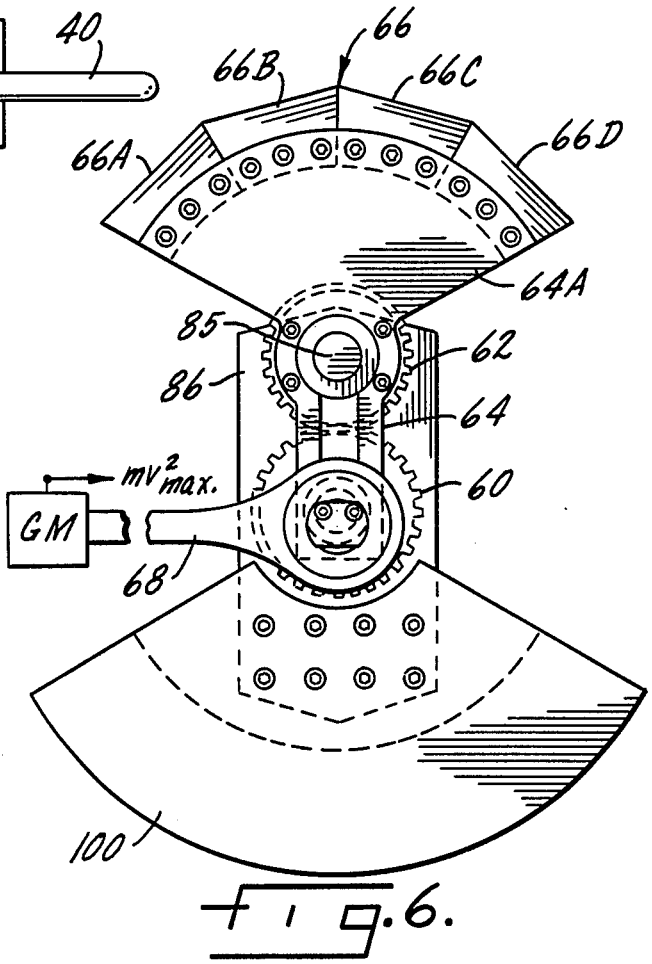
FIG. 6 is a fragmentary perspective view of the planetary gear system.

FIG. 6 may be referred to for a general description of the planetary gear system and a related mass or weight employed to reduce machine pulsing generated by stop and go shuttling of the gripper mass. The planetary gear system involves a sun gear 60, an external or epicyclic planetary gear 62 supported to revolve thereabout, a combined radius arm 64 and counter pulse weight 66 secured to the planetary gear for rotation therewith, and finally a drive bar 68. The combined radius arm 64 and weight 66 are secured by bolts to the front face of gear 62 for rotation therewith, synchronously, as will be described. Though the weight 66 rotates about the sun gear, the center of its mass oscillates up and down along a substantially straight path the midpoint of which is the axis or center of the sun gear. The drive bar 68 is pivotally connected at one end to the free or outer end of the radius arm 64, and at the opposite end is pivotally connected to the gripper support 28.

Figure 4:
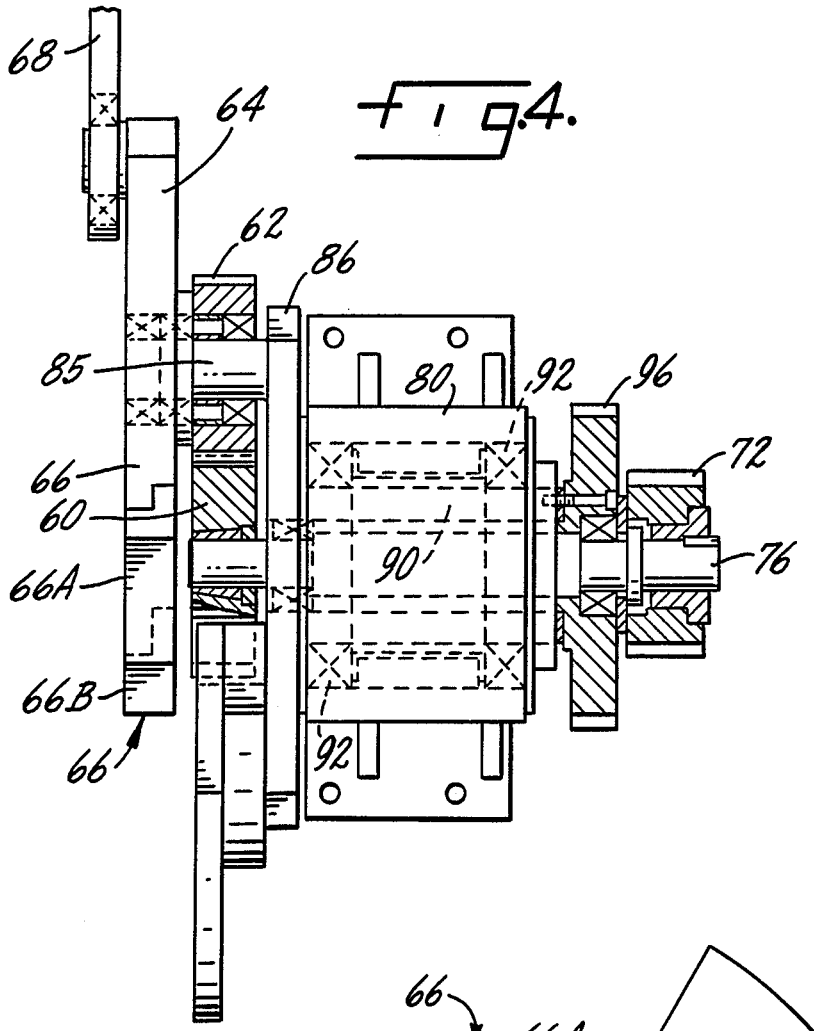
FIG. 4 is a top elevation view of the planetary gear drive and associated parts.

The sun gear is rotated about its own axis by a drive gear 72, FIG. 4. The planetary gear is meshed or mated directly with the sun gear 60 and is supported to revolve about the sun gear as noted. As the planetary gear revolves about the sun gear, it turns on its own axis and at the same time the radius arm 64 is turned to reciprocate the drive bar 68. Some of these movements are obscure and difficult to perceive. They are represented diagrammatically in FIG. 7, which will be addressed later.

As shown in FIG. 4, the drive gear 72 for sun gear 60 is keyed to a shaft 76 supported for rotation by bearing assemblies associated with a large cylindrical bearing housing 80.

Because of the necessary motions the sun gear is rotated. It could be fixed, as a fixed circular path for the planetary gear, but again, because of the needed motions it would be necessary to interpose an idler gear between the sun gear and the planetary gear.

In any event, the planetary gear 62, coupled to the sun gear 60, whether directly as shown or via an idler as mentioned, is supported for rotation about its own axis as it revolves (transits) the sun gear. This axis is a stub shaft 85 carried by a rotating planetary gear support arm 86. The planetary gear support arm 86 is secured for rotation to a sleeve 90 supported for rotation by large roller bearings 92 within housing 80.

The end of sleeve 90 opposite arm 86 is secured to a driving gear 96 at the rear of the machine. The two gears 72 and 96 are driven by respective main drive gears (not shown). In a machine of this kind there is always a main drive shaft and gear. Shaft 76 may be so viewed; other shafts are involved such as the shafts and related gearing (not shown) used to drive the conveyor and trimmer. These shafts are the sources of "shaft pulsing" mentioned above.

It will be seen from FIG. 4 that the sun gear 60 is rotated by gear 72 while arm 86 is rotated by gear 96. Arm 86 in effect revolves the planetary gear 62 in continuous transits about the sun gear.

As the planetary gear circumnavigates the sun gear it rotates on its own axis, and this rotation is accompanied by concurrent rotation of the radius arm 64 and the opposing weight or mass 66 which may be viewed as supported by an extension 64A of arm 64, FIG. 4, in the opposed radial direction. Rotation of the planetary gear (epicyclic) is employed to reciprocate the gripper mass and this is accomplished by drive bar 68. As best shown in FIG. 3, the end of drive bar 68 opposite the end which is pivotally connected to the free end of radius arm 64 is in turn pivotally connected to a lug 101 captured in a horizontal guide 102. This guide is identified in FIG. 1 as the guide track. The lug 101 has a laterally projecting ear 104 rigidly connected to a long link 106, the opposite end of which is connected to the gripper support 28.

The length of the radius arm 64 and the gear ratios are such that a single revolution or transit of the planetary gear 62 about the sun gear is accompanied by a single rotation of gear 62 and therefore a single vibration or complete reciprocal (to and fro) stroke of the gripper support 28.

Figure 7:
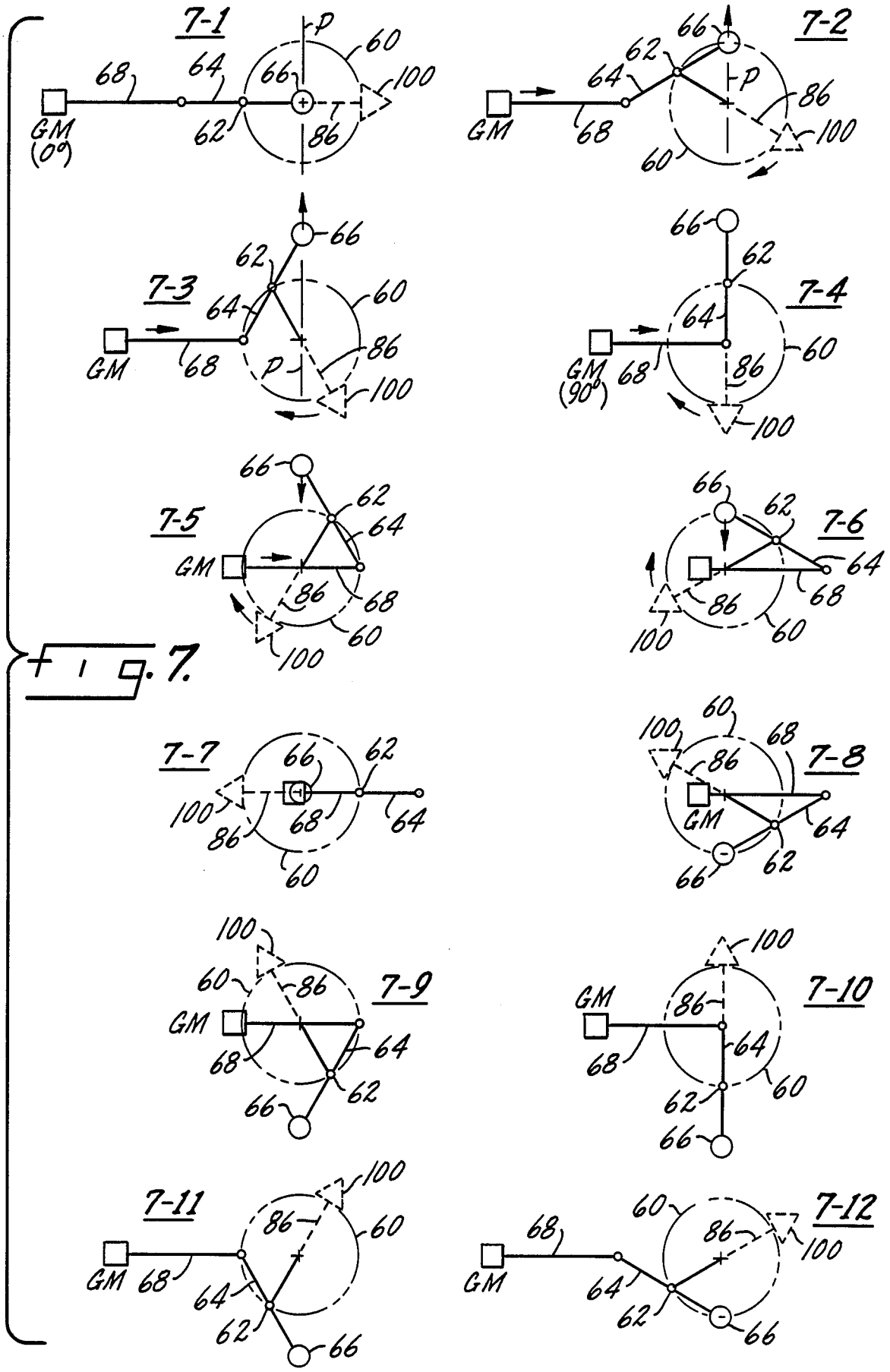
FIG. 7 is a series of schematic views showing features of the harmonic vibrations involved.

FIG. 7 is a diagram of the essential motions involved. The entirety of the gripper mass is represented by the block GM, reciprocated by the drive arm 68. The drive arm 68, as described above, is pivotally connected to the radius arm 64 and in FIG. 7 this is denoted by a small circle joining arms 64 and 68. Though the radius arm revolves, the epicyclic gear travel and the pivots (pins) which join the radius arm to the drive bar 68 produce horizontal translation of the drive bar 68, back and forth. The gripper mass therefore possesses harmonics.

The planetary gear is identified by another small circle in FIG. 7 (circle 62) moving about sun gear 60. Though the weight 66 also revolves about the sun gear it is positioned so that the center of its mass vibrates along a vertical path P coincident with the vertical diameter of the sun gear. The center of path P is the axis of gear 60.

The center of weight 66 undergoes one up and down vibration in the same period that the gripper mass GM makes a complete reciprocal movement which in terms of mechanics is also known as a vibration. Thus the mass represented by the weight 66 and the mass GM have the same frequency. Any body undergoing harmonic motion has an equilibrium position and a maximum displacement. The equilibrium position is the midpoint of the path taken by the vibrating body. For the gripper mass the equilibrium position is the midpoint of its horizontal path (90°; 270°). In an actual example, where the gripper mass undergoes a 24 inch stroke, as it may in the present machine, the midposition or equilibrium position will be at the 12 inch point, that is, halfway between the start position, when the grippers are starting the advance or feed stroke, and the end of that stroke where the gripper support starts its reverse movement back to the start position. Thus, the gripper mass has zero velocity at each end of the stroke and has maximum velocity at the midposition.

In comparison, the midposition or equilibrium position of the weight 66 is the axial center of the sun gear. Again, it must be taken into account that in FIG. 7 the effective path of the weight 66 is a straight line path P.

Continuing to refer to FIG. 7, position 7-1, the gripper mass GM at 0° position (start) is at its maximum displacement, while weight 66 is at a 90° equilibrium position, that is, weight 66 has no displacement along the harmonic path P.

In cyclical position 7-4, the gripper mass GM is undergoing maximum velocity at its 90° midposition (equilibrium) and the weight 66 is in a position of maximum displacement. Cyclical position 7-4 corresponds to what is shown in FIG. 6 and at this time the gripper mass (as viewed in FIG. 6) is moving in the direction of arrow $mv^2_{max}$ along its advancing stroke. In this instantaneous position it has its maximum velocity. It has its maximum velocity at cyclical position 7-4 because the radius arm 64, FIG. 6, is at the "bottom" of its stroke, FIG. 6, where its linear translation per unit of time is greatest. This also happens at the "top" of the stroke. At the same time, however, the center of mass represented by weight 66, FIG. 6, has reached the top of path P where its velocity is zero, though its displacement is maximum; at this moment the gripper mass, in equilibrium position, displays its maximum momentum $mv^2_{max}$.

Of more significance, however, are positions 7-1 and 7-7. At these positions, mass GM is undergoing instantaneous reversal. Thus, as mass GM approaches 0° on its return stroke (a few degrees from the 7-1 position) it is being decelerated for a full stop; at a moment later, it is being accelerated for the advancing stroke. This sequence of deceleration, stop, and reacceleration is repeated in the opposite direction at position 7-7. These are instantaneous actions at the reversing positions and mass GM adds torque to the system, especially the main motor (gearing) shafts, causing pulsing in the entire machine system, "shaft pulsing" as it has been termed. At these times, however (positions 7-1, 7-7), the weight 66 is traveling through midposition at $v^2_{max}$ and attenuates the pulses.

Another explanation is derived from FIG. 8. Assume the weight 66 and mass GM are in cross-slide tracks and a link 1*k* is pivotally connected to each. The mass GM is moving into the instantaneous $v^2_{min}$ position of maximum displacement (0°; instantaneous stop and reverse) but the pulse it will create at such instantaneous reversal is stretched out, flattened or smothered (attenuated) by the weight 66 which is approaching its equilibrium or midpoint position where its velocity is maximum. Thus the torque created when the gripper mass is reversed is in step or in phase with weight 66. This is further illustrated in FIG. 9.

Assume the gripper mass GM is a reciprocal rack meshed with a gear GI. At the moment of rack reversal from right (R) back to left (L), denoted by the double-ended arrow, beneath GM, the torque on gear G1 is reversed (Rv) from that which previously prevailed. But assume further that weight 66 is also a rack, driving gear G2 fast on the same shaft as gear G1. If rack 66 is undergoing linear translation in the direction of the arrow gear G2 is already turning the shaft in the $R_v$ direction.

To summarize, both the gripper mass and the countermass (weight 66) are bodies in harmonic motion with the same frequency, but out of phase. The gripper mass is in maximum displacement at the start or 0° position and also at the 180° position when the gripper support 28 is undergoing instantaneous reversal. The displacements are out of phase, 90° out of phase in fact for the ideal case, so that when the gripper mass is approaching a position of maximum displacement (whether on the forward stroke or return stroke) the weight 66 is approaching its equilibrium position where its linear velocity is greatest. On the other hand, when the gripper mass is approaching its highest velocity at midposition (momentum approaching maximum) the weight 66 is approaching either the top or bottom position where its linear horizontal speed is approaching zero. The vibrations of the two masses are 90° out of phase. The technical terms of mechanics and physics employed above (period, vibration, frequency, equilibrium position, displacement and momentum, for example) are taken from PHYSICS by Hausman and Slack (D. Van Nostrand Company, Third Ed., 1948).

As best shown in FIG. 6, the weight 66 is composed or made up of individual masses 66A, 66B and so on, bolted to the supporting arm 64A which is of segment shape. Thus, mass may be added or subtracted, or the center of gravity of the total mass may be shifted. In most cases, the masses are so balanced that the inertial center follows the straight line path P, FIG. 7, but if the pulses or vibrations induced by the gripper mass are not corrected by this configuration, the individual masses may be displaced selectively in which event path P might take on an eliptical character having a very small minor axis.

There is an additional force at work, identified with the gripper mass, which tends to shake the machine as distinguished from the creation of torque pulses due to instantaneous reversal at the end of the stroke. This additional force is represented by the momentum of the gripper mass, which reaches its highest value at midposition.

To counter the momentum of the gripper mass, a second weight 100, FIG. 6, is fastened to or otherwise supported on arm 86, diametrically opposite the stub shaft 85 on which the planetary gear 62 is journaled. Since arm 86 is rotating by virtue of its driven gear 96, FIG. 4, it orbits the sun gear as can be readily seen from the diagrams constituting FIG. 7. By comparing positions 7-1 and 7-2, FIG. 7, it can be seen that as the gripper mass is moving to the right, approaching its midposition, the counter momentum weight 100 is revolving in the clockwise direction. In position 7-4, the gripper mass GM is at its equilibrium or midposition. At this time, the counterweight 100 is at the nadir position, considered in terms of the axis of the sun gear, and consequently its horizontal velocity vector is of maximum value. In other words, as the gripper mass is approaching its maximum momentum position in one direction, the horizontal or linear velocity vector of weight 100 is approaching its maximum value in the opposite direction.

The epicyclic drive is capable of imparting a longer crank stroke (e.g. 24 inches) than a hypocyclic drive because the planetary gear 62 is on the outside of the sun gear. However, if a considerably shorter crank stroke is needed (e.g. 14 inches) a hypocyclic drive may be used, FIG. 10. Here, a stationary sun gear 110 is fixed against rotation as by securing it to a base 111 in an outboard position at the front of a gear reducer housing 112. The gear reducer drives an output shaft 114 to which couplings (not shown) are secured and to which, in turn, is secured a sleeve 113 centered for rotation therewith. A planetary gear 119 is journaled for rotation on a pin 120, and pin 120 is mounted in an opening 113A in the rim 113B of sleeve 113. Thus the arrangement is such that gear 119 is meshed with the (internal) teeth of gear 110 so that as sleeve 113 rotates the pinion or planetary gear 119 rotates on pin 120. Sleeve 113 is supported for rotation by bearings in the fashion described above in connection with FIG. 4.

A radius or crank arm 121 is fastened to gear 119 to rotate synchronously therewith. The free end of this arm serves the same function as that of crank arm 64 described above (driving the gripper bar and gripper bar support). The rim side of arm 121, opposite the free end, is of a size to allow a support for a counterpulse weight 123 to be secured thereto, this weight having the form and function of weight 66 described above.

The rim 113B of sleeve 113 is of a size to have secured thereto a countermomentum weight 124 corresponding to weight 100 described above.

Figure 5:
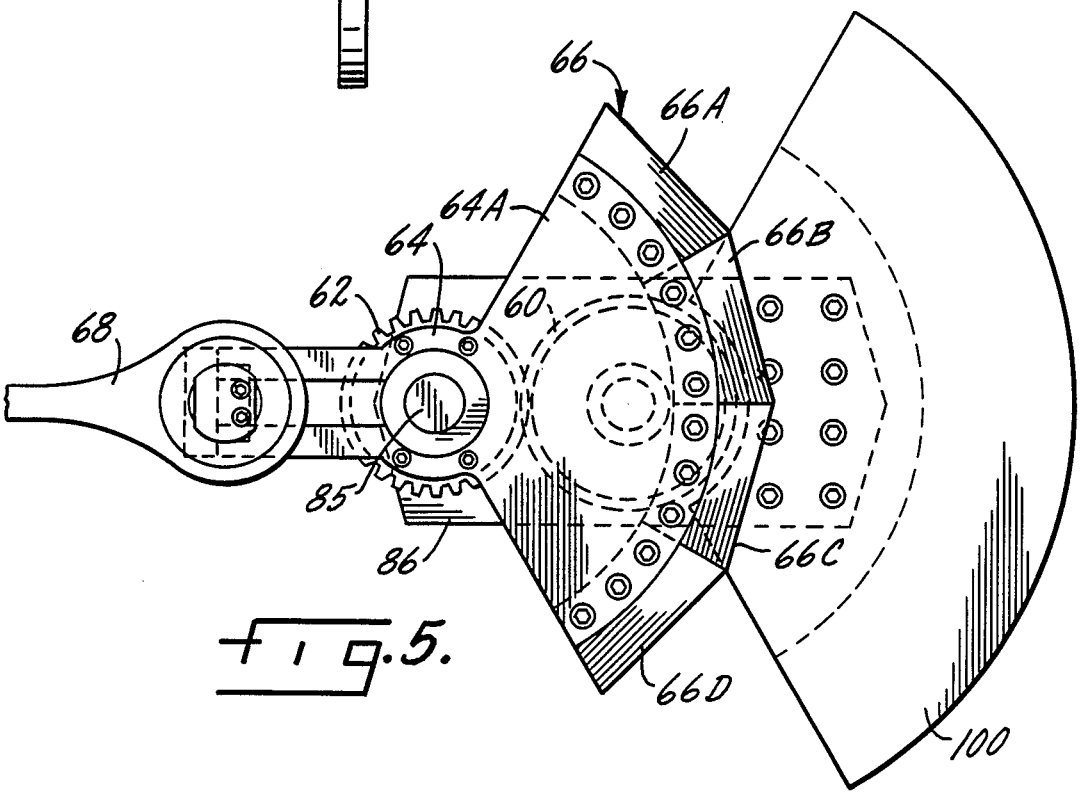
FIG. 5 is a front elevation of the planetary gear drive.

Thus, the weight to be carried by radius arm 121 and the weight to be carried by sleeve 113 comply with the performance characteristics of the corresponding weights of FIG. 5, described further by FIGS. 7, 8 and 9.

I claim:

1. In a cyclically operable signature machine having a conveyor in which signatures are collected one atop another as they are fed from hoppers to the conveyor which moves the collected signatures, constituting an unbound book, to a binder station where the signatures are joined at their backs to afford a bound book:

a set of grippers and support therefor at the stitching station, supported and guided for horizontal reciprocal shuttle action to feed the books through the stitching station;

a reciprocal drive bar connected at one end to the gripper support for producing a 360° cycle of horizontal shuttle action including a 180° forward feed stroke from starting position and a 180° nonfeed return stroke back to starting position;

a sun gear and a planetary gear coupled thereto and supported for repeated 360° revolutions relative to the sun gear;

said planetary gear being rotatable about its own axis while revolving relative to the sun gear and having a radius arm secured thereto for rotation therewith, and a counterpulse weight on a weight support extending radially outward of the axis of rotation of the planetary gear to rotate therewith;

the free end of said arm being pivotally joined to the opposite end of the drive bar so that as the planetary gear circumnavigates the sun gear through 360° the drive bar is reciprocated to reciprocate the gripper support and its mass harmonically with maximum velocity substantially at the midposition of each stroke;

and said counterpulse weight being so positioned radially that its harmonic displacement from midposition, taken as the axis of the sun gear, is approaching minimum when the displacement of the gripper bar mass from midposition is approaching maximum.

2. A signature machine according to claim 1 wherein the counterpulse weight is composed of individual masses separably fastened to said weight support so that the total weight may be selectively varied.

3. A signature machine according to claim 1 wherein a second weight in the machine is rotatably supported with its displacement opposed to the displacement of the gripper mass.

4. A signature machine according to claim 1 wherein a second weight in the machine is rotatably supported with its displacement opposed to the displacement of the gripper mass, and the first-named weight being so positioned on its support that the center of its mass reciprocates along a substantially vertical path as it is rotated.

5. A signature machine according to claim 4 in which the second weight is carried on a second arm secured to a gear-driven sleeve, said sleeve being coaxial with the sun gear.

6. A signature machine according to claim 1 in which the sun gear is rotated.

7. A signature machine according to claim 1 in which the sun gear is fixed.

8. A signature machine according to claim 5 in which the planetary gear is carried on said second arm in a position diametrically opposite the second weight.

9. In a cyclically operable signature machine having a conveyor in which signatures are collected one atop another as they are fed from hoppers to the conveyor which moves the collected signatures, constituting an unbound book, to a binder station where the signatures are joined at their backs to afford a bound book:

a mass supported and guided for horizontal reciprocal strokes as the books are fed through the stitching station;

a sun gear and a planetary gear coupled thereto, said planetary gear being supported for repeated 360° revolutions relative to the sun gear;

said planetary gear being rotatable about its own axis while revolving relative to the sun gear and having a radius arm secured thereto for rotation therewith, and a counterpulse weight on a support to rotate synchronously with the planetary gear;

the free end of said radius arm being pivotally linked to said mass so that as the planetary gear circumnavigates the sun gear through 360° said mass is reciprocated harmonically with maximum velocity substantially at the midposition of each stroke;

and said counterpulse weight being so positioned radially that its harmonic displacement from midposition, taken as the axis of the sun gear, is approaching minimum when the displacement of said mass from midposition is approaching maximum

10. A signature machine according to claim 9 wherein the counterpulse weight is composed of individual masses separably fastened to said weight support so that the total weight may be selectively varied.

11. A signature machine according to claim 9 wherein a second weight in the machine is rotatably supported with its displacement opposed to the displacement of said mass.

12. A signature machine according to claim 9 wherein a second weight in the machine is rotatably supported with its displacement opposed to the displacement of said mass, and the first-named weight being so positioned on its support that the center of its mass reciprocates along a substantially vertical path as it is rotated.

13. A signature machine according to claim 12 in which the second weight is carried on a second arm secured to a gear-driven sleeve, said sleeve being coaxial with the sun gear.

14. A signature machine according to claim 9 in which the sun gear is rotated.

15. A signature machine according to claim 9 in which the sun gear is fixed.

16. A signature machine according to claim 12 in which the planetary gear is carried on said second arm in a position diametrically opposite the second weight.

* * * * *